US010105613B1

(12) United States Patent
Patterson et al.

(10) Patent No.: US 10,105,613 B1
(45) Date of Patent: Oct. 23, 2018

(54) CONNECTABLE TOY FIGURINES

(71) Applicant: SPIN MASTER LTD., Toronto (CA)

(72) Inventors: Ian Patterson, Innisfil (CA); Charles Sink, Friday Harbor, WA (US); Anne Pitrone, Tenafly, NJ (US)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 15/828,961

(22) Filed: Dec. 1, 2017

(51) Int. Cl.

| | |
|---|---|
| ***A63H 11/14*** | (2006.01) |
| ***A63H 13/12*** | (2006.01) |
| ***A63H 3/16*** | (2006.01) |
| ***A63H 33/26*** | (2006.01) |

(52) U.S. Cl.
CPC ..... *A63H 3/16* (2013.01); *A63H 11/14* (2013.01); *A63H 13/12* (2013.01); *A63H 33/26* (2013.01)

(58) Field of Classification Search
CPC ..... A63H 11/14; A63H 13/12
See application file for complete search history.

(56) References Cited

U.S. PATENT DOCUMENTS

| | | | | |
|---|---|---|---|---|
| 147,558 | A * | 2/1874 | Hubbell | |
| 171,216 | A * | 12/1875 | DeForest | |
| 1,654,336 | A | 6/1925 | Lindstrom | |
| 1,584,979 | A | 5/1926 | Clausen | |
| 1,608,353 | A * | 11/1926 | Zaikine | A63H 13/04 446/138 |
| 2,148,374 | A * | 2/1939 | Hogan | A63H 11/14 446/234 |
| 2,195,083 | A * | 3/1940 | Einfalt | A63H 11/14 446/234 |
| 2,925,683 | A | 2/1960 | Cohn | |
| 4,573,939 | A * | 3/1986 | Hoshino | A63H 13/20 446/298 |
| 5,362,271 | A * | 11/1994 | Butt | A63H 3/36 446/129 |
| 5,957,745 | A * | 9/1999 | Johnson | A63H 11/14 446/233 |
| 6,042,451 | A | 3/2000 | Feldman | |
| 6,652,351 | B1 | 11/2003 | Rehkemper et al. | |
| 7,815,485 | B2 | 10/2010 | Moothedath et al. | |

(Continued)

FOREIGN PATENT DOCUMENTS

| | | | |
|---|---|---|---|
| JP | 6082962 | B2 | 2/2017 |
| WO | 00/51698 | A1 | 9/2000 |

*Primary Examiner* — John Ricci
(74) *Attorney, Agent, or Firm* — Millman IP Inc.

(57) ABSTRACT

A toy set having one or more figurines is provided. A first figurine has a motor coupled to a flywheel and a drive shaft to rotate the flywheel and the drive shaft. The drive shaft engages a support surface causing translation of the first figurine on the support surface when the drive shaft is rotated. The flywheel holds the first figurine generally upright on the support surface via gyroscopic force when the flywheel is rotated. The first figurine has a body representing a torso and at least one arm extending from the body, wherein the body and the at least one arm do not rotate with the flywheel. A second figurine is connectable to the first figurine to form a self-balancing assembly at least when the drive shaft engages the support surface and the flywheel is rotated by the motor. Rotation of the drive shaft causes translation of the self-balancing assembly on the support surface.

20 Claims, 10 Drawing Sheets

(56) References Cited

U.S. PATENT DOCUMENTS

| | | | | |
|---|---|---|---|---|
| 8,062,088 | B2 * | 11/2011 | Perry | A63H 33/046<br>446/101 |
| 8,382,550 | B2 | 2/2013 | Kang | |
| 9,550,131 | B2 * | 1/2017 | Loetz | A63H 33/26 |
| 9,559,519 | B2 | 1/2017 | Binder | |
| 9,586,153 | B2 | 3/2017 | Saunders | |

* cited by examiner

CONNECTABLE TOY FIGURINES

FIELD

The specification relates generally to animated toys. In particular, the following relates to connectable toy figurines.

BACKGROUND OF THE DISCLOSURE

Toy dolls have been provided which can be articulated to replicate poses assumed during activities such as dancing. Later dolls have been equipped with mechanisms that enable them to autonomously move without being articulated manually. In earlier cases, those dolls were set atop of a stationary platform that housed a mechanism for rotating the dolls about a vertical axis to give them the appearance of performing a pirouette, like "music box" type characters. These dolls, however, have a limited range of motion, are fixed in a location, and quickly become uninteresting to children.

SUMMARY OF THE DISCLOSURE

In one aspect, there is provided a set of connectable toy figurines, comprising a first figurine having a motor coupled to a flywheel and a drive shaft to rotate the flywheel and the drive shaft, the drive shaft engaging a support surface causing translation of the first figurine on the support surface when the drive shaft is rotated, the flywheel holding the first figurine generally upright on the support surface via gyroscopic force when the flywheel is rotated, and a second figurine that is connectable to the first figurine to form a self-balancing assembly at least when the drive shaft engages the support surface and the flywheel is rotated by the motor, and wherein rotation of the drive shaft causes translation of the self-balancing assembly on the support surface.

The second figurine can be connectable to a hand at a distal end of an arm extending from a body representing a torso of the first figurine. The second figurine can have a body representing a torso and from which extends at least one arm with a hand at a distal end thereof, the hand of the second figurine being connectable to the hand of the first figurine. The second figurine can be connectable to the first figurine via magnetic force. An electromagnet can be located at the hand of at least one of the first figurine and the second figurine. The electromagnet can be automatically variably activated.

The one arm of the first figurine can articulate relative to the body of the first figurine. The one arm of the second figurine articulates relative to the body of the second figurine.

The second figurine can be connectable to the body of the first figurine.

The second figurine can have a support surface engagement structure selected from the group consisting of at least one wheel, a plurality of ground engagement surfaces that are spaced apart, and a layer having a lower friction coefficient than a base material of the second figurine. The support surface engagement structure can comprise at least three wheels. The at least one wheel can be a castor. The second figurine can maintain itself in an upright orientation via the support surface engagement structure.

The second figurine can maintain itself in an upright orientation on a generally flat surface.

The second figurine can have a weighted base.

The second figurine can have a vibration mechanism.

The first figurine can further have a controller that varies the speed of the motor.

In another aspect, there is provided a set of connectable toy figurines, comprising a first figurine having a flywheel rotated by a motor to hold the first figurine generally upright on a support surface via gyroscopic force and to move the first figurine on the support surface, and a second figurine that is connectable to the first figurine to form a self-balancing assembly at least when the flywheel is rotated by the motor, wherein rotation of the flywheel causes translation of the self-balancing assembly on the support surface.

The second figurine can be connectable to the first figurine via magnetic force.

In a further aspect, there is provided a connectable toy figurine for use with a gyroscopic figurine, the gyroscopic figurine having a flywheel rotated by a motor to hold the gyroscopic figurine generally upright on a support surface via gyroscopic force and to move the gyroscopic figurine on the support surface, the connectable toy figurine comprising a connection feature that is connectable to the gyroscopic figurine such that the connectable toy figurine and the gyroscopic figurine form a self-balancing assembly at least when the flywheel is rotated by the motor, wherein rotation of the flywheel causes translation of the self-balancing assembly on the support surface.

BRIEF DESCRIPTIONS OF THE DRAWINGS

For a better understanding of the various embodiments described herein and to show more clearly how they may be carried into effect, reference will now be made, by way of example only, to the accompanying drawings in which.

Figure 8A:
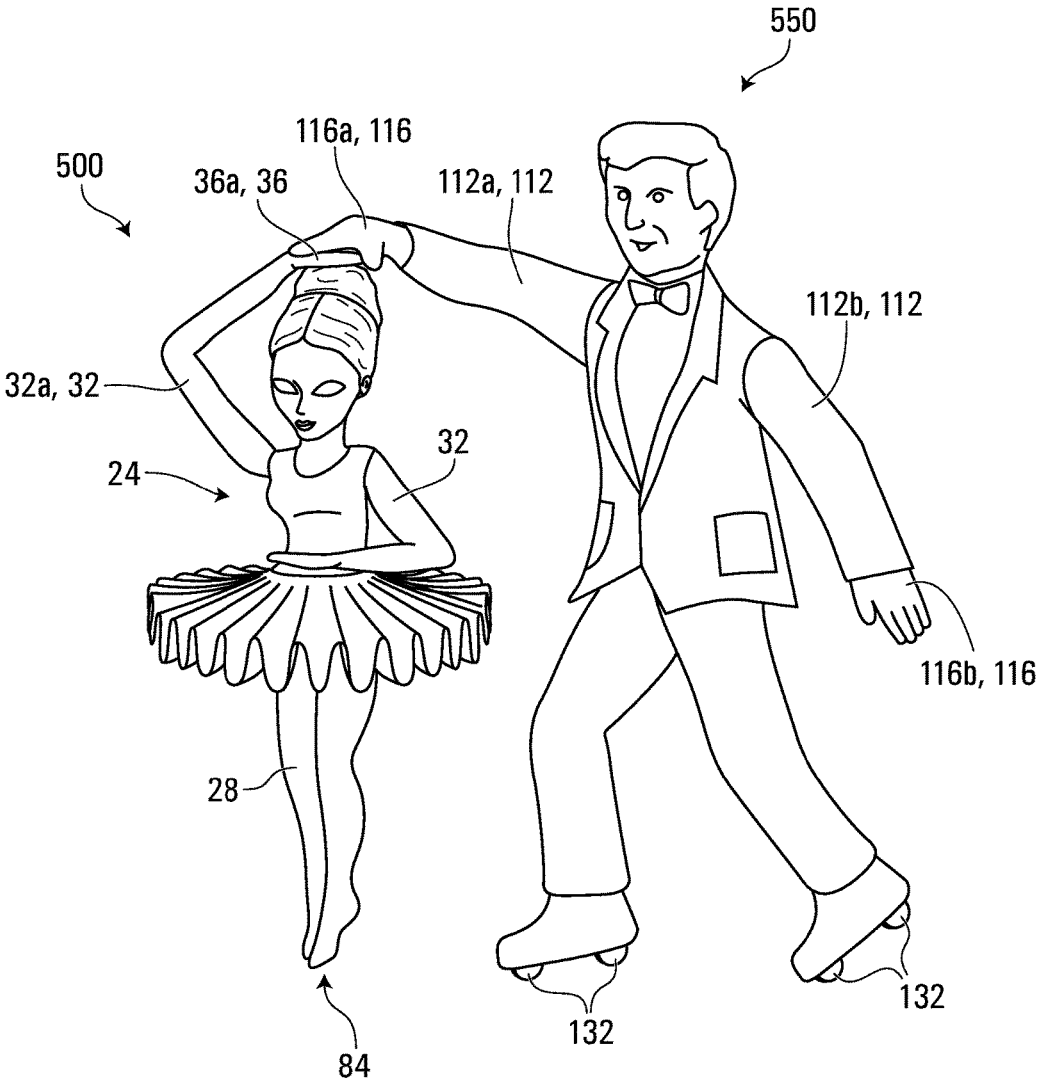
FIG. 8A is an illustration of a toy set of figurines wherein a hand at a distal end of an articulating arm of a gyroscopic figurine is positioned above the head and connected to a hand at a distal end of an articulating arm of an accompaniment figurine in a higher first position in accordance with another embodiment.
Figure 8B:
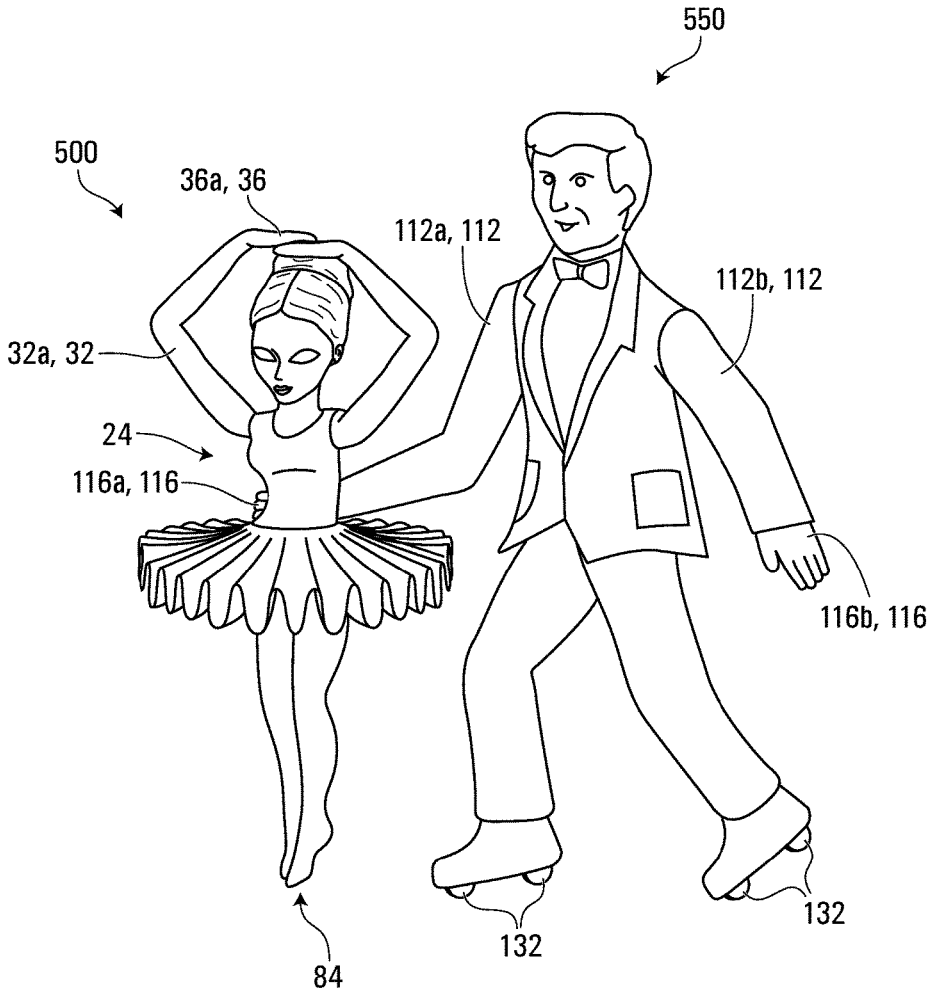
Figure 8C:
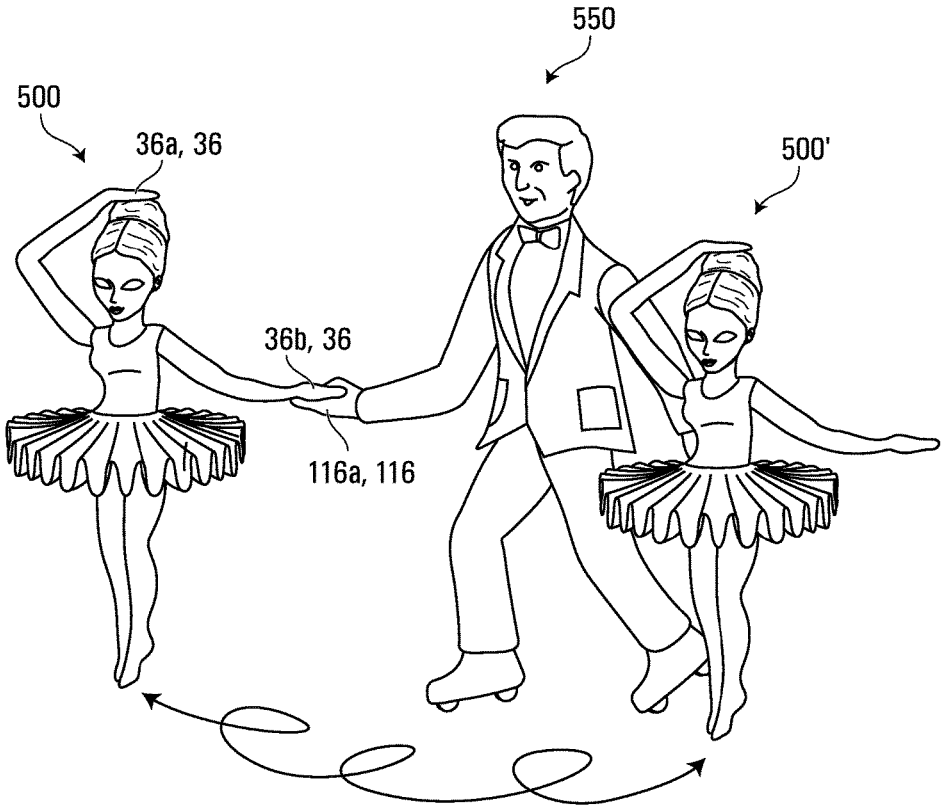

FIG. 8B shows the hand at the distal end of the articulating arm of the accompaniment figurine in a lower second position connected to a body of the gyroscopic figurine of FIG. 8A; and FIG. 8C shows a second hand at a distal end of a second articulating arm of the gyroscopic figurine of FIGS. 8A and 8B having moved to a lower position below her head to couple with the hand of the accompaniment figurine in the lower second position, as well as a second position of the gyroscopic figurine after having moved along a surface wherein a second hand at a distal end of a second arm of the second figurine is connected to the body of the gyroscopic figurine.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Described herein are toy sets having at least two figurines. The figurines can be representative of any form, such as human, animal, robot, other inanimate object, etc. A first figurine has a motor coupled to a flywheel and a drive shaft to rotate the flywheel and the drive shaft. The drive shaft engages a support surface causing translation of the first figurine on the support surface when the drive shaft is rotated. A second figurine is connectable to the first figurine to form a self-balancing assembly at least when the drive shaft engages the support surface and the flywheel is rotated by the motor. Rotation of the drive shaft causes translation of the self-balancing assembly on the support surface.

This enables the first figurine and the second figurine, when connected together, to move together to give the appearance that they are dancing together freely on the support surface.

Figure 1:
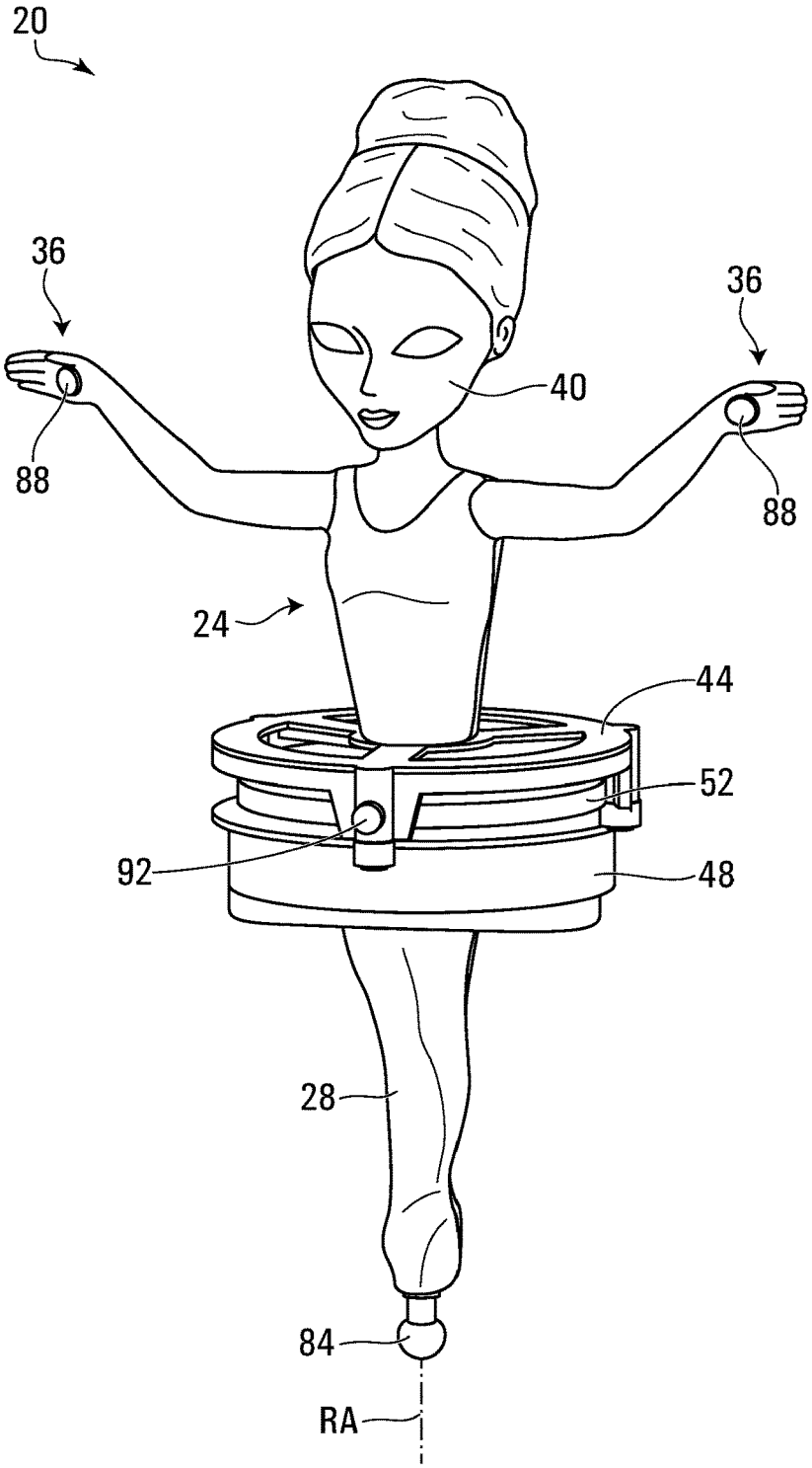
FIG. 1 is a front top side perspective view of a gyroscopic figurine of a toy set in accordance with one embodiment.

FIG. 1 shows a gyroscopic figurine 20 of a toy set in accordance with an embodiment. The gyroscopic figurine 20 has the form of a dancing doll. The gyroscopic figurine 20 has a body 24 representing a torso from which extend a pair of legs 28. A pair of arms 32 also extend from the body 24, each having a hand 36 at a distal end thereof. A head 40 is positioned atop of the body 24.

Figure 2:
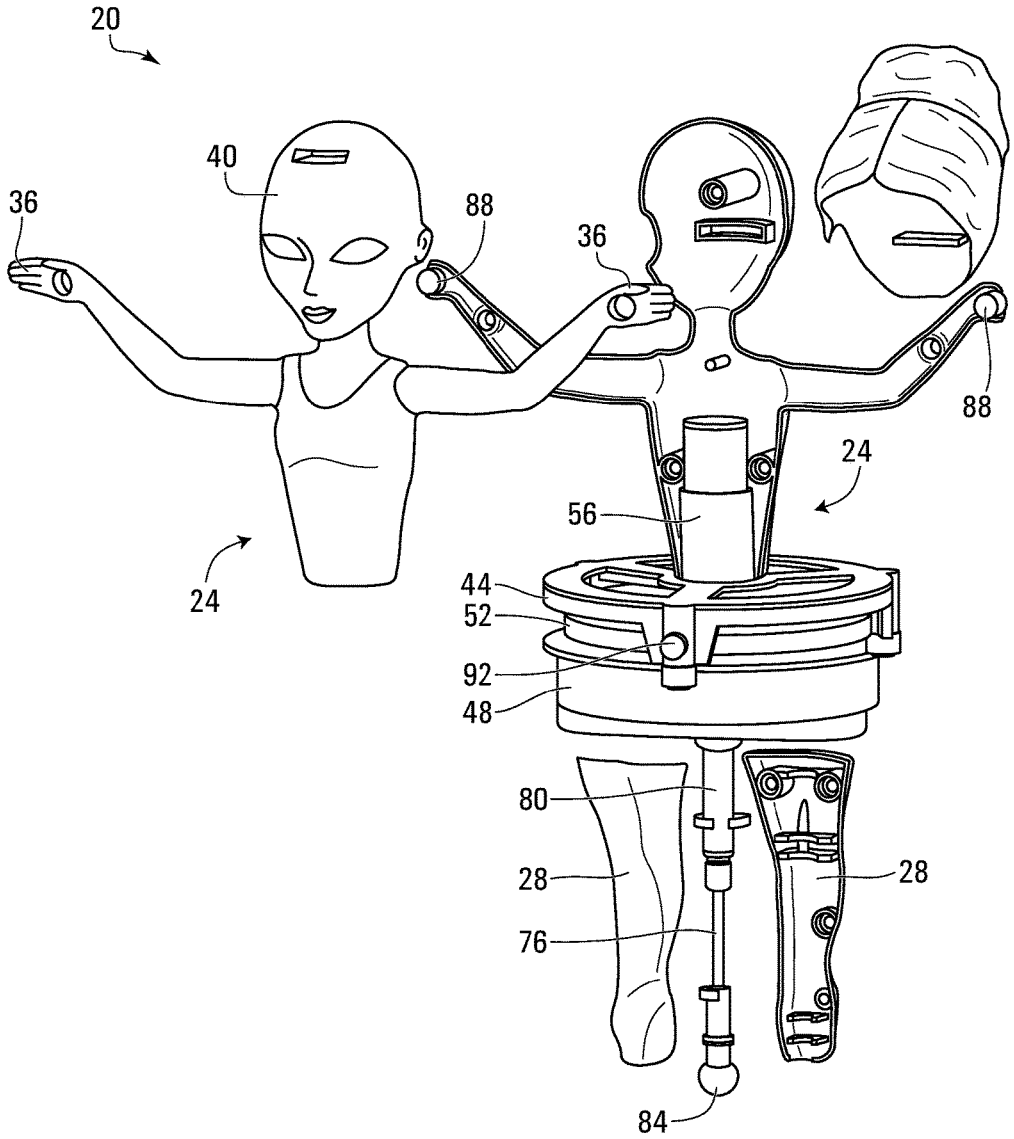
FIG. 2 is a partially exploded front top side perspective view of the gyroscopic figurine of FIG. 1.
Figure 3:
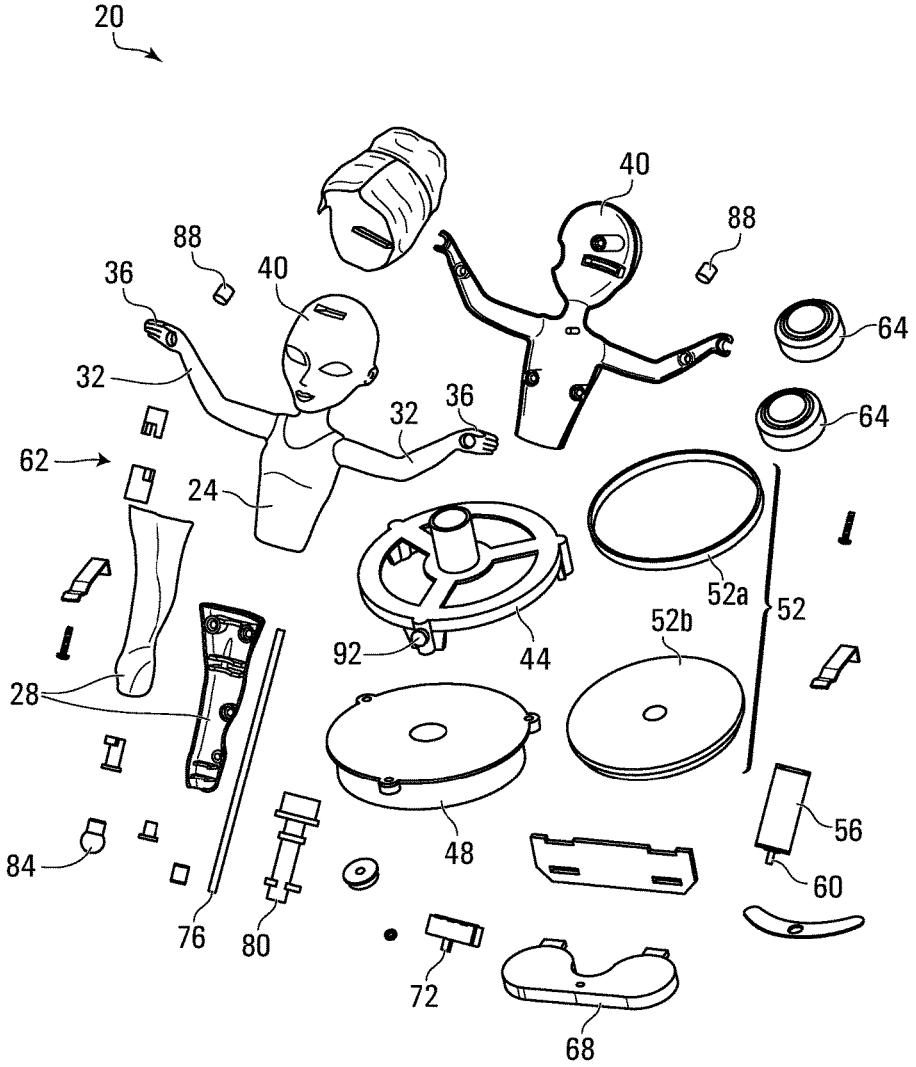
FIG. 3 is a disassembled view of the gyroscopic figurine of FIGS. 1 and 2.

Now with reference to FIGS. 1 to 3, as can be seen, the body 24 and the head 40 of the gyroscopic figurine 20 are formed from two molded parts. The body 24 is shown including a gyroscope housing formed of a flywheel cover 44 and a battery enclosure 48. The flywheel cover 44 and the battery enclosure 48 shield a flywheel 52. In this embodiment, the flywheel 52 is a heavy metal ring 52*a* mounted about the circumference of a support disk 52*b*. The flywheel 52 is mounted such that it can be rotated about a rotation axis RA that is generally parallel to a longitudinal axis of the body 24 of the gyroscopic figurine 20 in the current embodiment. In other embodiments, the flywheel 52 can be any other mass that, when rotated, provides resistance to reorientation of the gyroscopic figurine 20 to hold the gyroscopic figurine generally upright on a support surface via gyroscopic force.

The flywheel 52 forms part of a gyroscopic drive mechanism that includes an electric motor 56 that is secured within the body 24 and has a primary drive shaft 60 coupled to the flywheel 52 via a coupling 62. The electric motor 56 rotates the primary drive shaft 60, causing the flywheel 52 to rotate when the electric motor 56 is activated. A pair of batteries 64 are mounted under a battery cover 68 and power the electric motor 56. A switch 72 controls activation of the electric motor 56.

A secondary drive shaft 76 is coupled to the flywheel 52 at a proximal end via a shaft connector 80 that is fitted within a circular opening on the underside of the flywheel 52. When connected, the secondary drive shaft 76 is generally coaxial with the rotation axis RA of the electric motor 56 and the flywheel 52. A ground contact surface 84 in the form of a rounded knob is coupled to a distal end of the secondary drive shaft 76. In other embodiments, the ground contact surface may be formed on the secondary drive shaft.

A connection feature in the form of a magnet 88 is secured within each hand 36 of the gyroscopic figurine 20. The magnets 88 are placed within the hands 36 such that each has the same polarity oriented outwardly from the palms of the hands 36.

The arms 32 of the gyroscopic figurine 20 are articulable at the shoulder such that the hands 36 and, thus, the magnets 88 can be moved between at least two positions.

In addition, a connection feature, also in the form of a magnet 92, is secured to a front side of the flywheel cover 44; that is, to its body 24. The magnet 92 has a polarity oriented outwardly from the flywheel cover 44.

The gyroscopic figurine 20 is garbed in a dress (not shown) to give the appearance of a ballerina, ballroom dancer, etc.

The gyroscopic drive mechanism of the gyroscopic figurine 20, when activated, spins the flywheel to generate angular momentum. This angular momentum of the flywheel 52 causes the gyroscopic figurine 20 to maintain its orientation generally upright on a support surface via gyroscopic force. That is, when the gyroscopic figurine 20 is upright, with the ground contact surface 84 in contact with a support surface, and its body generally extending vertically above the ground contact surface 84, and the flywheel 52 is spinning, the gyroscopic figurine 20 resists reorientation (i.e., falling over).

Further, the rotation of the coupled ground contact surface 84 causes the gyroscopic figurine 20 to move on the support surface. The gyroscopic figurine 20 may generally move in roulettes or other types of curves or motions. Additionally and/or alternatively, the gyroscopic figurine 20 can rotate.

Figure 4:
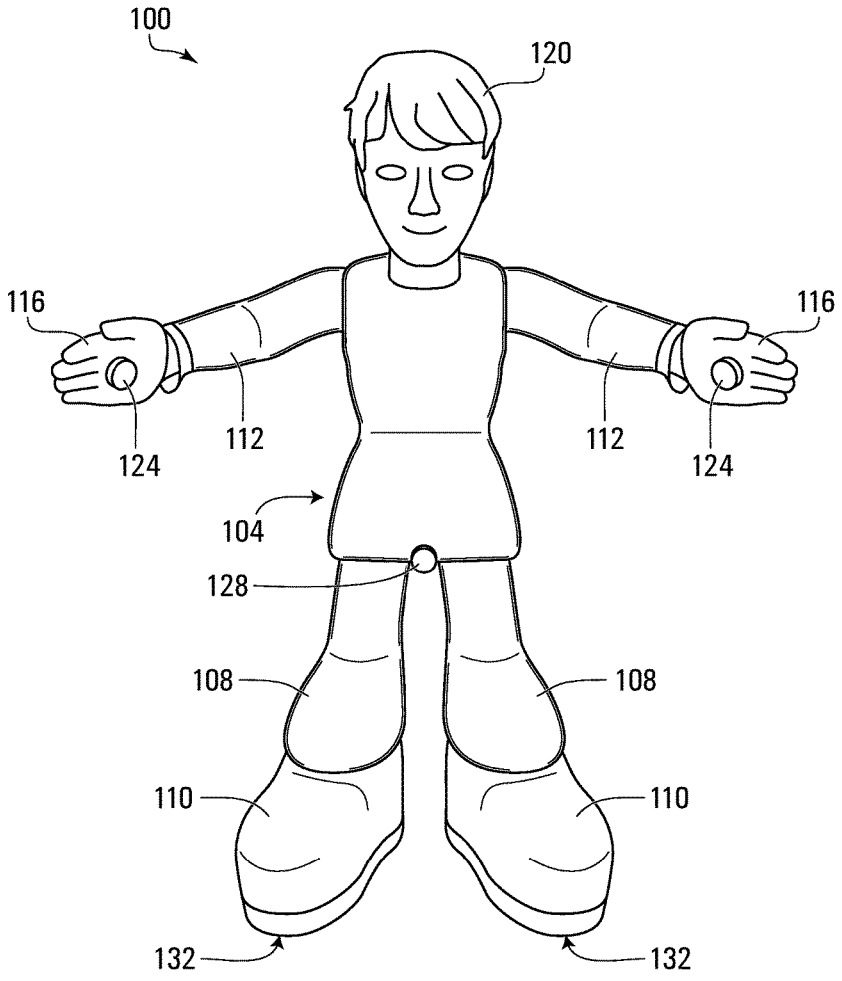
FIG. 4 is a front view of an accompaniment figurine of the toy set of FIGS. 1 to 3.

An accompaniment figurine 100 is shown in FIG. 4. The accompaniment figurine 100, like the gyroscopic figurine 20, has the form of a dancing doll. The accompaniment figurine 100 has a body 104 representing a torso from which extends a pair of legs 108 with a pair of feet 110 at the distal ends thereof. A pair of arms 112 also extend from the body 104, each having a hand 116 at a distal end thereof. A head 120 is positioned atop of the body 104.

A connection feature in the form of a magnet 124 is secured within each hand 116 of the accompaniment figurine 100. The magnets 124 are placed within the hands 116 such that each has the same polarity oriented outwardly from the palms of the hands 116. In particular, the polarity of the magnets 124 oriented outwardly from the palms of the hands 116 is opposite of that of the magnets 88 oriented outwardly from the palms of the hands 36 of the gyroscopic figurine 20 such that the magnets 124 attract the magnets 88.

Like the arms 32 of the gyroscopic figurine 20, the arms 112 of the accompaniment figurine 100 are articulable at the shoulders such that the hands 116 and, thus, the magnets 88 can be moved between at least two positions.

In addition, a connection feature, also in the form of a magnet 128, is secured to a front side of the body 104 of the accompaniment figurine 100. The magnet 128 has a polarity oriented outwardly that is opposite of the magnet 92 secured to the flywheel cover 44 such that the magnet 128 attracts the magnet 92.

A support surface engagement structure in the form of a pair of wheels 132 are located under each foot 110. The wheels 132 reduce resistance of movement of the accompaniment figurine 100 on a support surface. In addition, lead slugs (obscured from view) are placed in the feet 110. The form of the accompaniment figurine 100, the lead slugs and the configuration of the foot 110 and wheels 132 enable the accompaniment figurine to be self-standing or self-balancing. That is, the accompaniment figurine 100 can maintain itself in an upright orientation when placed on a level support surface.

Figure 5A:
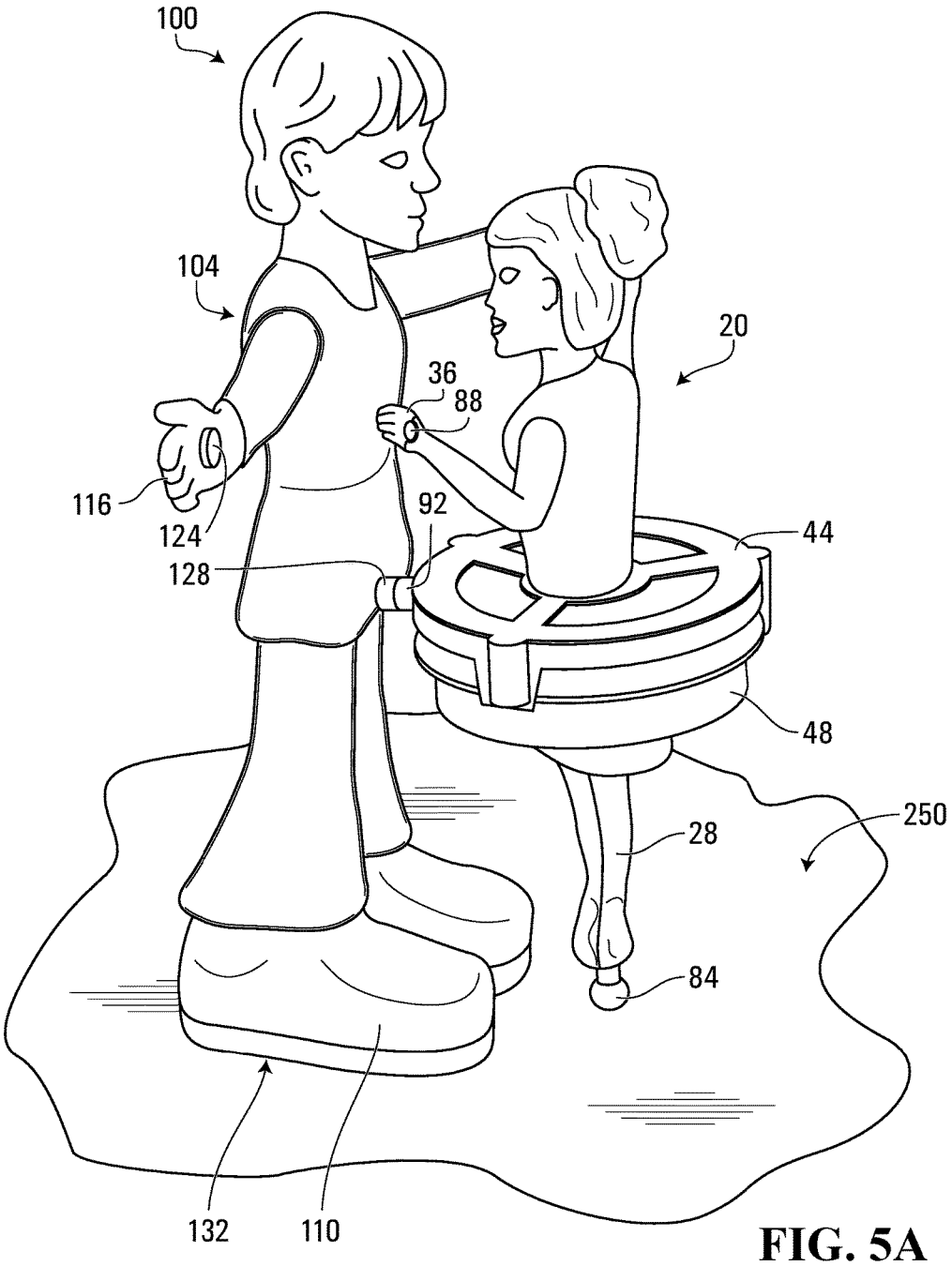
FIG. 5A shows the gyroscopic figurine and the accompaniment figurine of FIGS. 1 to 4 connected at the bodies.

FIG. 5A shows the gyroscopic figurine 20 connected to the accompaniment figurine 100 on a support surface 250. As shown, the magnet 92 on the body 24 of the gyroscopic figurine 20 is connected to the magnet 128 on the body 104 of the accompaniment figurine 100. When the gyroscopic figurine 20 is connected to the accompaniment figurine 100, the gyroscopic figurine 20 and the accompaniment figurine 100 form a self-balancing assembly at least when the ground contact surface 84 of the secondary drive shaft 76 engages the support surface 250 and the flywheel 52 is rotated. When the gyroscopic drive mechanism of the gyroscopic figurine 20 is activated, the rotary motion of the ground contact surface 84 drives the gyroscopic figurine 20 and the accompaniment figurine 100 to which it is coupled to move on the support surface 250. The wheels 132 facilitate movement of the accompaniment figurine 100 over the support surface 250 to enable the accompaniment figurine 100 to move together with the gyroscopic figurine 20.

Figure 5B:
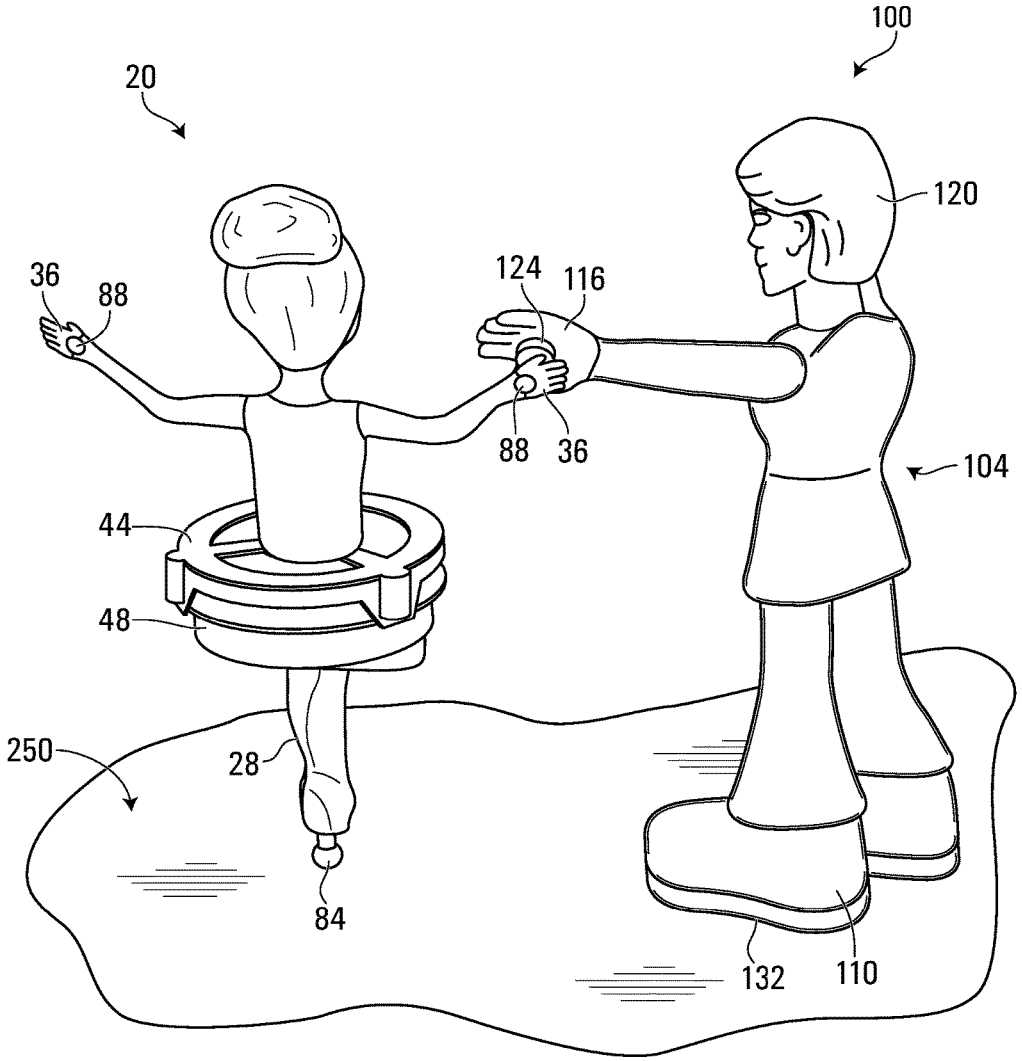
FIG. 5B shows one of the hands of the gyroscopic figurine connected to one of the hands of the accompaniment figurine of FIG. 5A.

FIG. 5B shows the magnet 88 (hidden from view) of one of the hands 36 of the gyroscopic figurine 20 connected to the magnet 124 of one of the hands 116 of the accompaniment figurine 100. The magnetic force between the magnets 88, 124 is sufficiently strong to inhibit separation as the gyroscopic figurine 20 and the accompaniment figurine 100 move about the support surface 250. The gyroscopic figurine 20 and the accompaniment figurine 100 move about the support surface in a manner that simulates a dancing motion.

At least the arms 32 of the gyroscopic figurine 20 and/or the arms 108 of the accompaniment figurine 100 may articulate to enable the motion of the gyroscopic figurine 20 and the accompaniment figurine 100 to appear somewhat natural. In other embodiments, the hands of the figurines may be articulable relative to the arms to further simulate natural movement.

Figure 6:
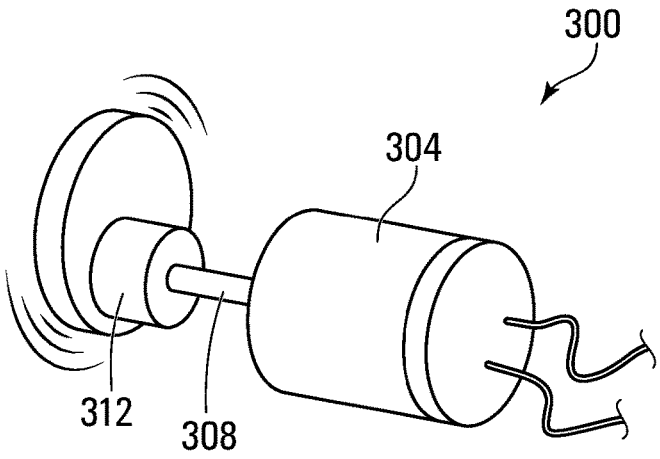
FIG. 6 shows a vibration mechanism that can be deployed in the accompaniment figurine of FIGS. 4 to 5B.

FIG. 6 shows a vibration mechanism 300 that can be deployed in an accompaniment figurine in accordance with another embodiment. The vibration mechanism 300 includes a motor 304 from which extends a drive shaft 308 coupled to an eccentric weight 312. When the motor 304 is activated, the motor 304 drives the drive shaft 308 and the coupled eccentric weight 312 to rotate. The eccentricity of the eccentric weight 312 causes the vibration mechanism 300, and the surrounding accompaniment figurine, to vibrate to give the appearance of more erratic and/or energetic dancing to the accompaniment figurine. While, in this embodiment, the vibration mechanism is a vibratory motor, in other embodiments, it can be any other device for generating a vibration force.

Figure 7:
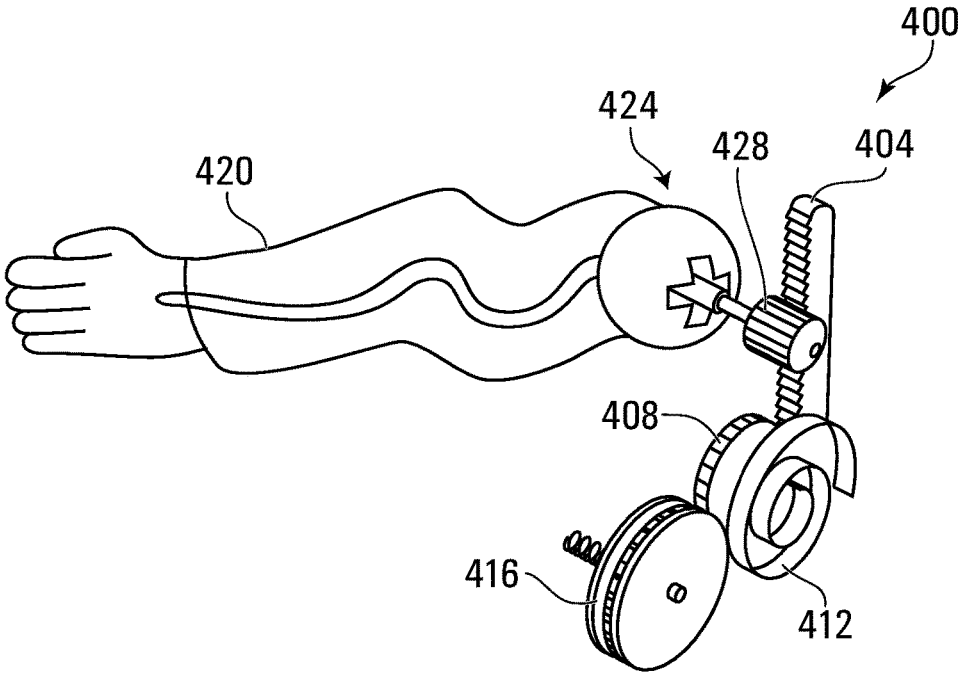
FIG. 7 shows an automatic arm articulation mechanism of an accompaniment figurine of a toy set in accordance with another embodiment.

FIG. 7 shows an arm movement mechanism 400 that can be employed by the accompaniment figurine in another embodiment. The arm movement mechanism 400 includes a rack 404 with missing teeth in meshed engagement with a motion control gear 408 that is driven by a coil spring 412. The rack 404 is slidably mounted within the body of the accompaniment figurine. The motion control gear faces a spring-loaded clutch plate 416 with a slow grease being applied to its surface to slow movement of the motion control gear 408. An arm 420 has a shoulder joint 424 that is coupled to an arm gear 428 via a cruciform driver to allow positioning. The coil spring 412 stores energy to drive the rack 404 upwards.

In order to cause the arm of the accompaniment figurine to move, the rack 404 is pushed down to wind up the coil spring 412. Coil tension of the coil spring 412 causes the motion control gear 408 to rotate, albeit slowly as a result of contact with the slow grease of the clutch plate 416. As the rack 404 is driven back up, the arm gear 428 is rotated by the toothed sections on the rack 404 to cause the arm 420 to move downwards. The arm 420 can be biased via a spring or the like to an upward orientation when the arm gear 428 is not engaged by the teeth of the rack 404.

Further, the arm 420 can be sufficiently flexible to permit adjustment of its shape without compromising its ability to maintain its general rigidity to cause the accompaniment figurine to dance somewhat fixedly relative to a gyroscopic figurine.

FIG. 8A shows a gyroscopic figurine 500 that is very similar to the gyroscopic figurine 20 of FIGS. 1 to 3. Like numbered and described elements of the gyroscopic figurine 500 are the same or are functionally the same as their counterparts in the gyroscopic figurine 20 of FIGS. 1 to 3. The magnets of the gyroscopic figurine have been replaced with ferromagnetic elements, such as iron masses. Of note is that the arms 32 of the gyroscopic figurine 500 pivot quite freely at the shoulder. A dress 504 has been fitted over the body 24 of gyroscopic figurine 500 to give the appearance of a performance dancer.

Also shown is an accompaniment figurine 550 that is somewhat similar to the accompaniment figurine 100 of FIG. 4, except that the accompaniment figurine 550 includes a mechanism similar to that of FIG. 7 for pivoting its arms 112. Still further, the accompaniment figurine 550 includes connection features in the form of electromagnets positioned on its hands 116 in place of the magnets 124 used with the accompaniment figurine 100. The electromagnets may be sufficiently strong when activated to attract the iron mass in one of the hands 36 of the gyroscopic figurine 500. In particular, the accompaniment figurine 550 is shown with its right arm 112*a* being pivoted such that its right hand 116*a* is held in a high position as shown. The iron mass in the right hand 36*a* of the right arm 32*a* is attracted to the right hand 116*a* of the accompaniment figurine 550 when the electromagnet thereof is activated. The accompaniment figurine 550 has been outfitted with a suit to give the appearance of a performance dancer.

FIG. 8B shows the accompaniment figurine 550 after pivoting of the right arm 112*a* so that the right hand 116*a* thereof is adjacent a connection feature in the form of a ferromagnetic element on the back of the body 24 of the gyroscopic figurine 500. The electromagnets may be automatically variably activated by a controller or other mechanism. In order to pivot the right arm 112*a*, the electromagnet is deactivated or reversed so that the right hand 116*a* can be moved away from the right hand 36*a* of the gyroscopic figurine 500. After the right arm 112*a* of the accompaniment figurine 550 has been pivoted so that the right hand 116*a* is adjacent the ferromagnetic element on the back of the gyroscopic figurine 500, the electromagnet is reactivated or reversed again so that it attracts the ferromagnetic element on the back of the gyroscopic figurine to couple the two figurines 500, 550 together.

FIG. 8C shows a "move" wherein the left hand of the gyroscopic figurine 500 is first coupled to the right hand 116*a* of the accompaniment figurine 550. Deactivation of the electromagnet in the right hand 116*a* of the accompaniment figurine 550 enables the gyroscopic figurine 500 to move away from the accompaniment figurine 550. Activation of a corresponding electromagnet in the left hand 116*b* of the accompaniment figurine 550 attracts the gyroscopic figurine 500 to it. The second position of the gyroscopic figurine 500 is shown as 500'.

Activation of the electromagnets and the gyroscopic drive mechanism can be automated by a controller such as a microprocessor that is programmed or otherwise configured to activate and deactivate them. Further, movement of the arms of the figurines may be controlled by the same or a similar controller.

While, in the above embodiments, the connection features used to connect the figurines are illustrated and described as being magnets, electromagnets, and/or ferromagnetic elements, the connection features can be any other feature on one or both of the figurines to connect and hold the figurines together as they move across a support surface. For example, the connection features can be hook and loop fabric elements provided on the figurines to enable them to be releasably connected. In another example, the connection features can include a revolute joint, such as a hooked arm, on at least one of the figurines. Other types of connection features include, for example, snaps and adhesive elements.

The connection features preferably enable the figurines to be releasably connected, such as those described above. Alternatively, the connection features can be used to permanently connect the figurines together in other embodiments.

While, in the above-described embodiments, the gyroscopic figurine includes a ground contact surface that rotates, in other embodiments, the ground contact surface can be passive, such as a castor wheel. Alternatively, the ground contact surface can be replaced or augmented with a magnetic element to enable the gyroscopic figurine to at least partially hover over a magnetic or ferromagnetic support surface.

The support surface engagement structure of the accompaniment figurine can additionally or alternatively have other features to reduce resistance to move across a support surface. In one embodiment, a castor wheel and a number of projections that are spaced apart can be provided on the bottom surface of the accompaniment figurine. The projections may have a height that enables standing of the accompaniment on the castor and at least two of the projections when not coupled to the gyroscopic figurine and, when coupled to the gyroscopic figurine, the accompaniment figurine may travel on the single castor. In other embodiments, any combination of castors, wheels, and/or other features can be employed. In yet another embodiment, the support surface engagement structure can be a magnetic element that at least partially repels a support surface, such as a metallic sheet, etc. In still another embodiment, the support surface engagement structure can be a layer having a lower friction coefficient than a base material of the accompaniment figurine. For example, a Teflon™ coating can be provided over the base material, which may be a molded plastic.

While, in the above-described and illustrated embodiments, the accompaniment figurines are self-standing (that is, they can maintain themselves upright on a support surface when alone), it other embodiments, the accompaniment figurines may be unable to stand upright on their own on a flat support surface and may require coupling to the gyroscopic figurine to maintain their upright stance.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A toy set having at least two figurines, comprising:

a first figurine having a motor coupled to a flywheel and a drive shaft to rotate the flywheel and the drive shaft, the drive shaft engaging a support surface causing translation of the first figurine on the support surface when the drive shaft is rotated, the flywheel holding the first figurine generally upright on the support surface via gyroscopic force when the flywheel is rotated; and a second figurine that is connectable to the first figurine to form a self-balancing assembly at least when the drive shaft engages the support surface and the flywheel is rotated by the motor, and wherein rotation of the drive shaft causes translation of the self-balancing assembly on the support surface.

2. A toy set as claimed in claim 1, wherein the second figurine is connectable to a hand at a distal end of an arm extending from a body representing a torso of the first figurine.

3. A toy set as claimed in claim 2, wherein the second figurine has a body representing a torso and from which extends at least one arm with a hand at a distal end thereof, the hand of the second figurine being connectable to the hand of the first figurine.

4. A toy set as claimed in claim 3, wherein the second figurine is connectable to the first figurine via magnetic force.

5. A toy set as claimed in claim 4, wherein an electromagnet is located at the hand of at least one of the first figurine and the second figurine.

6. A toy set as claimed in claim 5, wherein the electromagnet is automatically variably activated.

7. A toy set as claimed in claim 3, wherein the one arm of the second figurine articulates relative to the body of the second figurine.

8. A toy set as claimed in claim 2, wherein the one arm of the first figurine articulates relative to the body of the first figurine.

9. A toy set as claimed in claim 1, wherein the second figurine is connectable to the body of the first figurine.

10. A toy set as claimed in claim 1, wherein the second figurine has a support surface engagement structure selected from the group consisting of at least one wheel, a plurality of ground engagement surfaces that are spaced apart, and a layer having a lower friction coefficient than a base material of the second figurine.

11. A toy set as claimed in claim 10, wherein the support surface engagement structure comprises at least three wheels.

12. A toy set as claimed in claim 10, wherein the at least one wheel is a castor.

13. A toy set as claimed in claim 10, wherein the second figurine maintains itself in an upright orientation via the support surface engagement structure.

14. A toy set as claimed in claim 1, wherein the second figurine maintains itself in an upright orientation on a generally flat surface.

15. A toy set as claimed in claim 1, wherein the second figurine has a weighted base.

16. A toy set as claimed in claim 1, wherein the second figurine has a vibration mechanism.

17. A toy set as claimed in claim 1, wherein the first figurine further comprises a controller that varies the speed of the motor.

18. A toy set having at least two figurines, comprising:

a first figurine having a flywheel rotated by a motor to hold the first figurine generally upright on a support surface via gyroscopic force and to move the first figurine on the support surface; and a second figurine that is connectable to the first figurine to form a self-balancing assembly at least when the flywheel is rotated by the motor, wherein rotation of the flywheel causes translation of the self-balancing assembly on the support surface.

19. A toy set as claimed in claim 18, wherein the second figurine is connectable to the first figurine via magnetic force.

20. A connectable toy figurine for use with a gyroscopic figurine, the gyroscopic figurine having a flywheel rotated by a motor to hold the gyroscopic figurine generally upright on a support surface via gyroscopic force and to move the gyroscopic figurine on the support surface, the connectable toy figurine comprising:

a connection feature that is connectable to the gyroscopic figurine such that the connectable toy figurine and the gyroscopic figurine form a self-balancing assembly at least when the flywheel is rotated by the motor, wherein rotation of the flywheel causes translation of the self-balancing assembly on the support surface.

* * * * *